US008708878B2

(12) United States Patent
Masuda et al.

(10) Patent No.: US 8,708,878 B2
(45) Date of Patent: Apr. 29, 2014

(54) FUNCTIONAL ROLL INCORPORATING A STRUCTURE OF A LATTICE-SHAPED FLUID (GAS-LIQUID) GUIDEPATH

(75) Inventors: Masanobu Masuda, Aichi (JP); Noriaki Masuda, Aichi (JP)

(73) Assignees: Masuda Seisakusho Co., Ltd., Aichi (JP); Masroll Systems Inc., Aichi (JP)

( * ) Notice: Subject to any disclaimer, the term of this patent is extended or adjusted under 35 U.S.C. 154(b) by 671 days.

(21) Appl. No.: 12/855,272

(22) Filed: Aug. 12, 2010

(65) Prior Publication Data

US 2011/0039672 A1 Feb. 17, 2011

(30) Foreign Application Priority Data

Aug. 12, 2009 (JP) ..... 2009-187466
Dec. 24, 2009 (JP) ..... 2009-293388

(51) Int. Cl.
*F16C 13/00* (2006.01)
*B05C 1/08* (2006.01)

(52) U.S. Cl.
USPC ..... 492/56; 492/17; 492/38; 492/40; 492/48; 492/49

(58) Field of Classification Search
USPC ..... 492/28, 17, 20, 32, 38, 39, 40, 41, 48, 492/49, 50, 51, 56
See application file for complete search history.

(56) References Cited

U.S. PATENT DOCUMENTS 3,710,469 A * 1/1973 Kitazawa ..... 492/40
4,283,821 A * 8/1981 Paakkunainen ..... 492/28

(Continued)

FOREIGN PATENT DOCUMENTS

DE 4422775 C1 9/1995
EP 0105391 A2 4/1984

(Continued)

OTHER PUBLICATIONS

Machine Translation of JP 5180216.*

(Continued)

*Primary Examiner* — Sarang Afzali
(74) *Attorney, Agent, or Firm* — Westerman, Hattori, Daniels & Adrian, LLP

(57) ABSTRACT

Conventional art has a structure consisting of a roll axis incorporating a structure of fine pores, and a roll unit provided around the outer circumference of a roll axis, wherein internal pressure of the roll axis is dispersed to the roll unit to make a fluid (gas-liquid) suction action, thus reducing the pressure loss and obtaining even distribution of the fluid (gas-liquid). As such, instead of a tubular roll axis, the structure of a roll axis is made fin-shaped or groove-shaped to maximize the action surface area that works on the inner pressure of the roll axis of the roll unit. However, other problems such as inefficiency of the fluid (gas-liquid) suction action and lack of mechanical strength of the roll axis remains. To solve these problems, this invention provides a functional roll incorporating a structure of a lattice-shaped fluid (gas-liquid) guidepath made of high-density porous sheet material to activate the internal pressure of the roll axis, therein the structure of the lattice-shaped fluid (gas-liquid) guidepath, consisting of an internal pressure action space made of a cut-out portion provided on the circumference of the roll axis, and in the axis direction of the roll unit, and an internal pressure branching guidepath made of low-density porous sheet material, or a space communicating with the internal pressure action space, as well, being provided in the radial direction of the roll unit.

2 Claims, 13 Drawing Sheets

(56) References Cited

U.S. PATENT DOCUMENTS

| | | | | |
|---|---|---|---|---|
| 4,535,611 | A * | 8/1985 | Masuda | 68/202 |
| 4,769,924 | A | 9/1988 | Hikota et al. | |
| 5,038,469 | A * | 8/1991 | Masuda et al. | 29/895.213 |
| 5,307,563 | A * | 5/1994 | Svenka | 29/895.213 |

FOREIGN PATENT DOCUMENTS

| | | | |
|---|---|---|---|
| EP | 0139519 | A2 | 5/1985 |
| EP | 0414218 | A1 | 2/1991 |
| JP | 59-043189 | A | 3/1984 |
| JP | 61-000390 | Y2 | 10/1984 |
| JP | 61-000391 | Y2 | 11/1984 |
| JP | 1-084213 | U | 6/1989 |
| JP | 5-180216 | A | 7/1993 |
| JP | 7-113577 | A | 5/1995 |
| JP | 2009-041868 | A | 2/2009 |
| JP | 2009-280883 | A | 12/2009 |

OTHER PUBLICATIONS

Appeal Decision (JP4484168) w/ Partial Translation.

European Search Report dated Dec. 8, 2010, issued in corresponding European Patent Application No. 10007370.

* cited by examiner

FUNCTIONAL ROLL INCORPORATING A STRUCTURE OF A LATTICE-SHAPED FLUID (GAS-LIQUID) GUIDEPATH

CROSS-REFERENCE TO RELATED APPLICATIONS

This application claims priority under 35 U.S.C. §119 to Japanese Patent Application No. 2009-187466, filed Aug. 12, 2009, and Japanese Patent Application No. 2009-293388, filed Dec. 24, 2009. The contents of these applications are incorporated herein by reference in their entirety.

TECHNICAL BACKGROUND

1. Field of Invention

This invention refers to a functional roll consisting of a roll axis having air-liquid permeability and a roll unit (roll operative part) provided on the outer surface of the roll axis, and sustainable works for removing or applying air/liquid to objects. The roll unit of the functional roll incorporates a structure to absorb solutions, cleaning water or the like of objects being treated, and/or to apply solutions, cleaning water or the like to objects being treated, by controlling the internal pressure of the roll axis.

2. Background Art

Conventional arts relating to this invention have a structure consisting of selected elements such as a number, diameters, and alignments of pores provided on a roll axis, with the roll unit itself being provided on the outer circumference of the roll axis together with its thickness, dimensions or the like, and based on such a structure, the internal pressure of the roll axis is dispersed and distributed to the roll unit, and consequently a fluid (gas-liquid) suction action is made. Also, the conventional art of a functional roll is designed to reduce pressure loss, and to distribute evenly such fluid (gas-liquid) by replacing an ordinary (tubular) roll axis with a roll axis comprising a structure of fins or grooves, so that the surface (exposed) area being engaged by the inner pressure of the roll axis of the roll unit is maximized.

Conventional arts relating to the structure of the roll axis of this invention are here described.

Conventional art (1), filed by the same inventor of the present application, is Japanese Published Unexamined Patent Application No. H05-180216, entitled "Method of Manufacturing Laminated Roll Using Non-woven Sheet-like Material Incorporating High Repulsion and Non-viscosity, and Laminated Roll Incorporating Composite Structure." This conventional art discloses a laminated roll incorporating a composite structure consisting of a cylindrical axis with an axis unit made of retainers provided at both ends of the cylindrical axis, and a bearing and multiple fine pores provided on the peripheral surface of the axis, and connected to the hollow portion of the axis, and a roll unit with a fluid (gas-liquid) suction action, that is fitted into the axis unit, and therein a through-hole being provided on the bearing, which are connected to the hollow portion of the axis unit. The feature of the conventional art (1) is the formation of a laminated roll by overlapping and compressing high-density non-woven sheet-like material (high density pad) and coarse non-woven sheet-like material (low density pad) to make a roll unit having fine pores of desirable density. Thus, fluid (gas-liquid) such as water, chemical solutions or the like, that may remain on the surface of a steel band (strip) in rapid motion, can efficiently be removed and/or absorbed fluid (gas-liquid) suction action.

In the invention of (1), the hollow portion of the axis unit and the pores are surely connected. However, it is not always likely that the fine pores and the coarse and low density pads that are multiply overlapped and compressed are properly connected. Thus, apparently fluid (gas-liquid) suction action is not fully achieved.

Conventional art (2), also filed by the same inventor of the present application, is a Japanese Published Unexamined Utility Model Patent Application No. H01-84213, entitled, "Suction Roll Apparatus Incorporating Disk-shaped Composite Roll Material". This conventional art (2) discloses a suction roll apparatus incorporating a cylindrical axis unit, an axis assembly made of retainers provided at both ends of the cylindrical axis unit, and a bearing and multiple pores that are provided on the peripheral surface of the axis unit and connected to the hollow portion of the axis unit, and a roll unit with fluid (gas-liquid) suction action, incorporating an elastic porous unit that is fitted into the axis unit, and a microfiber body provided on the outer circumference of the elastic porous unit, and therein a through-hole being provided on the bearing which are connected to the hollow portion of the axis unit. The specific feature of the conventional art (2) is that it provides an auxiliary chamber at the junction of the roll unit and the axis unit for fluid (gas-liquid) saved by the spacer. Thus, a similar function of fluid (gas-liquid) suction, as described about conventional art (1) is realized.

However, the above utility patent models still need some improvements, such as a spacer structure being provided on the axis unit. However, such improvements will make the structure complicated and may deteriorate the stability required to hold the roll unit, and may cause further problems regarding the mechanical strength of the axis unit.

(Patent Document 1) Japanese Published Unexamined Patent Application No. H05-180216 (Patent Document 2) Japanese Published Unexamined Utility Model Patent Application No. H01-84213

SUMMARY OF THE INVENTION

Considering the specific feature of the functional roll in this invention, actual performance highly depends on the functional property and efficiency of the roll unit, in other words, how to make the internal pressure of the roll axis work on the roll unit.

However, even though the material of the roll unit, regarding the density, size or the like is defined to obtain improved functionality and efficiency, there may still be some problems that cannot be resolved simply by using such material of density, size or the like. Contrary to what is expected of the density, size or the like, unfavorable functionalism or inefficiency may often be realized.

As one solution, there is a method for improving the fine pores provided on the roll axis, like those of the functional rolls of the above related inventions (1), (2) and other commercially-available functional rolls. For instance, a structure relating to the number, diameter, and alignment of the fine pores can be improved. However, considering the mechanical and structural requirements, such as strength (strength) or the like, that form the function of the roll axis, the above structure still has limitations. Thus, there are still problems regarding the desired number, diameter and alignment of the fine pores that cannot be resolved. Nor it is likely that the fine pores can be uniformly allocated, and it is generally thought that loss of compression or the like may occur. However, even if such roll units are used, they still fall far short of the preferable condition whereby a roll unit produces high efficiency and equal effect. Therefore, practically speaking, it is necessary to redesign the above inventions.

Regarding the functional rolls as described in the above related inventions (1) and (2), as well as other commercially available functional rolls, when it comes to designing the structure of a roll axis to maximize its surface area that works on the internal pressure of the roll axis of the roll unit, limitations of the structure and its shape eventually make it difficult to keep mechanical stability and practical utility.

Regarding the functional rolls as described in the above related inventions (1) and (2), as well as other commercially available functional rolls, a certain basic function regarding this field is now recognized. However, it is still skeptical that the optimum property of those functional rolls is sufficiently exemplified, just as the present invention comprising a functional roll incorporating elastic non-woven sheet material (non-woven sheet material of high repulsion and of non-viscosity) to make a fluid (gas-liquid) suction force and to maintain its original shape for a long time under the harsh conditions of production lines, fluid (gas-liquid) applications or the like on the surfaces of steel bands (strips) in rapid motion, or to remove fluid (gas-liquid) or the like from the highly heated surfaces of steel bands (strips) or from functional composite sheet material, in which cross-linking elastic material is provided on non-woven material.

Therefore, the present invention is aimed at dispersing and distributing the inner pressure of the roll axis into the roll unit, so that the fluid (gas-liquid) suction action of the roll unit efficiently reduces the pressure loss of the fluid (gas-liquid) suction action, so that equal distribution is achieved. (In other words, a rational structure of low pressure loss and high efficiency is achieved. Thus, the fluid (gas-liquid) suction action is activated by the inner pressure of the roll unit, itself, to provide a structure maximizing the active surface area (exposed area) against the inner pressure of the roll axis.

The first aspects of this invention are to provide (A) a functional roll in which a roll unit (a roll action site and a fluid permeable roll unit, or action-site roll unit) made of sheet material incorporating high-density pores (fluid permeable material in the shape of a disk) is provided over the circumference of a tubular roll axis incorporating fluid (gas-liquid) permeability, therein the functional roll is connected to a fluid (gas-liquid) suction device with a structure for transferring the internal pressure of the roll axis to the roll action site, to sustain the action of absorbing or applying fluid (gas-liquid) whilst controlling the fluid (gas-liquid) volume, to work on the hollow portion of the roll axis through the roll action site, and (B) a structure in which the internal pressure of the roll axis is dispersed and distributed into the roll unit, so that fluid (gas-liquid) suction action is efficiently invoked, and a pressure loss of the fluid (gas-liquid) suction action is intentionally reduced, together with equal distribution of fluid (gas-liquid). Thus, a rational structure with low pressure loss and high efficiency is achieved. Subsequently, the original function of the roll unit that is worked by the internal pressure of the roll axis is maximally invoked, and the active surface area (exposed area) of the roll unit against the internal pressure of the inner side of the roll axis is expanded.

The first aspect of this invention refers to a functional roll incorporating a lattice-shaped fluid (gas-liquid) guidepath structure consisting of a tubular roll axis incorporating multiple fine pores, and a roll unit having its roll hole engaged with the roll axis, made of elastic non-woven sheet material or of high-density porous sheet material of a functional composite sheet material obtained by providing cross-linking elastic material onto the non-woven material, therein the roll unit comprises a lattice-shaped fluid (gas-liquid) guidepath structure to activate the internal pressure of the roll axis, the lattice-shaped fluid (gas-liquid) guidepath structure being formed by an internal pressure action space made of a cut-out portion which is provided on the circumferential area of the roll and in the axial direction of the roll unit as well as an internal pressure branching guidepath which is connected to the internal pressure action space and provided in the radial direction of the roll unit, made of a lower-density porous sheet material (compared with the aforementioned high-density porous sheet material) with a roll hole, made of elastic non-woven sheet material or of a functional composite sheet material, therein a cross-linking elastic body is provided on the non-woven material, that is characterized in activating internal pressure to the aforementioned roll unit through the lattice-shaped fluid (gas-liquid) guidepath structure.

The second aspect of this invention is to achieve the objective of the first aspects of this invention, and thus provide the most appropriate shape and structure of the cut-out portion provided in the axial direction of the roll unit, as well as provide a structure of the roll axis with multiple pores, and fully fluid (gas-liquid) permeability, for actual use in equipment, and with the number of fine pores, diameter of pores, or the like being sufficient to secure the mechanical strength of the roll axis.

The second aspect of this invention refers to a functional roll incorporating a lattice-shaped fluid (gas-liquid) guidepath structure as described in the first aspect of this invention, characterized in that the cut-out portion provided in the axial direction of the roll unit is in tubularly cross-sectionally shaped with low-resistance along its flow passage, therein the multiple cut-out portions are circumferentially aligned.

The third aspect of this invention is to achieve the objective of the first aspects of this invention, and thus provide the most appropriate inner circumference structure of the cut-out portion provided in the axial direction of the roll unit (i.e. the interface area between the roll axis and the inner circumference area of the cut-out portion of the roll unit is expanded), as well as provide a structure of the roll axis with multiple pores to fully realize the internal pressure action of the roll axis against the roll action site for actual use in equipment, and with the number of fine pores, diameter of pores, or the like being sufficient to secure the mechanical strength of the roll axis.

The third aspect of this invention refers to a functional roll incorporating a lattice-shaped fluid (gas-liquid) guidepath structure as described in the first aspect of this invention, characterized in that the tubular inner circumference area, made by the cut-out portions provided in the axial direction of the roll unit, comprises upper portions and lower portions in the axial direction, to expand the inner circumferential area.

Efficiency: The art of this invention makes it possible to efficiently operate the significant output power of comparably-sized rolls. Table 1 below shows comparative vacuum values, whilst FIG. 16 shows the relationship between air volume and Q. In the conventional art, Ia and Ib shows a great loss, i.e. great loss in air volume and efficiency. On the other hand, the art of this invention shows low loss and high efficiency in the flat Q-characteristics.

TABLE 1

| Vacuum Pumping Capacity | Vacuum value: Conventional art | Vacuum value: Present invention |
|---|---|---|
| 5.5 kW | Ia −80 kPa (−610 mmHg) | IIa −59 kPa (−450 mmHg) |
| 7.5 kW | Ib −89.5 kPa (−680 mmHg) | IIb −82.7 kPa (−620 mmHg) |

Fluid (gas-liquid) Removal Capability: Compared with the conventional art that is greatly affected by the inlet condition (see FIG. 17 below), the art of this invention delivers high performance and is not affected by the inlet condition, due to the above-mentioned efficiency. As shown in Table 2, compared with the absolute values of conditions wherein the fluid (gas-liquid) volume at the inlet side is low, this invention apparently shows high performance, especially when using comparatively viscous fluid (gas-liquid), so that an unconventionally higher level of performance is realized.

TABLE 2

| Fluid (gas-liquid) | Volume of residual fluid (gas-liquid) at outlet, $g/m^2$: Water fluid (gas-liquid) | | Oil fluid (gas-liquid) | |
|---|---|---|---|---|
| Volume at inlet, $g/m^2$ | Conventional art | Present invention | Conventional art | Present invention |
| 1.0 | 0.2 | 0.0 | 0.7 | 0.4 |
| 2.0 | 0.5 | 0.0 | 1.2 | 0.5 |

Stability—I: FIG. 18 shows the measurement of variation regarding surface absorbability ($g/m^2$·sec per unit area·second) of the roll unit (roll action site) during actual use. The variation of absorbability is affected by dirt or the like accumulated whilst in actual use. However, it can be renewed by regular grinding and removal maintenance (dressing) of the surface part of the roll unit (roll action site). In the art of this invention, the aforementioned efficiency is greatly recognized as a variation character of the surface absorbability of the roll unit, enabling it to sustain a high level of performance as compared to the conventional art.

Stability—II: As shown in FIG. 19 below, the conventional art is likely to cause instability, such that the absorbed amount, i.e. fluid (gas-liquid) permeability varying irregularly, and the resistance (vacuum value) increasing cumulatively. For example, a non-homogeneous liquid such as emulsion oil generates high resistance depending on the size of the oil component, the oil concentration or the like, or showing non-homogeneous fluidity or the like that generates the above instability. This invention secures the aforementioned efficiency, and provides a structure to procure more such efficiency to the surface of the roll unit, thus resulting in the stable performance as shown in FIG. 19—Comparative evaluation of the acceleration test on the same conditions.

The aforementioned effect or part of it may be achieved by maximally reducing the density and thickness of the roll unit, and by maximizing the number and diameter of the fine pores that form the fluid (gas-liquid) permeable structure of the roll axis, not depending on the art and structure of this invention. However, such an invention is not practical enough to fulfill its purposes, such as mechanical strength, the structural requirement of the roll axis, a consistent performance of the roll axis which realizes uniform distribution, the processing quality (fluid removal capability), or the like.

BRIEF DESCRIPTION OF THE DRAWINGS

FIG. 15-1 is a partially-cut and enlarged cross-sectional view of the major structure, as shown in FIG. 13, showing another type of internal pressure action space (having an upper and lower portion provided on the cut-out portion).

FIG. 15-2 is a side view of the high-density porous sheet material, as shown in FIG. 13, incorporating circular pores and a concave-convex shaped inner circumference area to expand the circumference area.

DETAILED DESCRIPTION OF THE INVENTION

Figure 1:
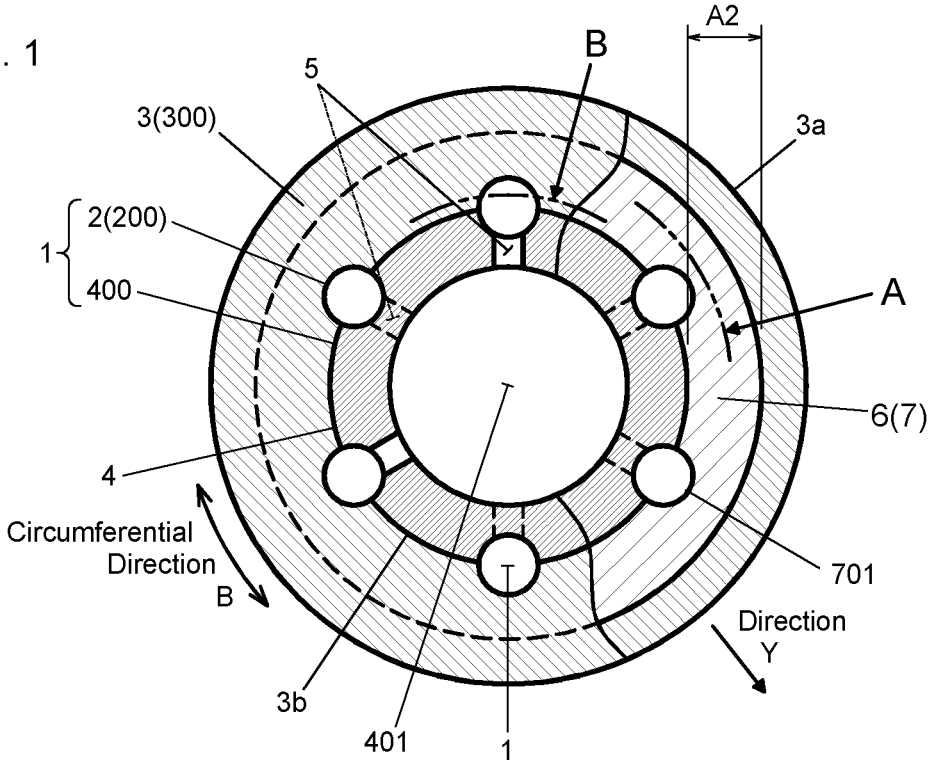
FIG. 1 is a cross-sectional view of a functional roll as the first embodiment, partially cut in the circumferential direction of turning.

Embodiments of this invention are hereby described referring to the drawings.

Figure 5:
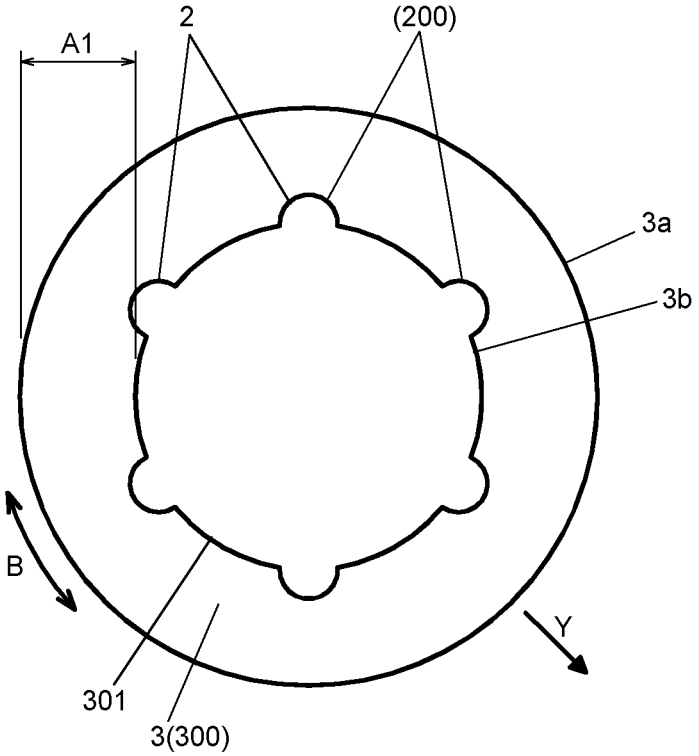
FIG. 5 is an enlarged side view of the high-density porous sheet material as commonly used in all embodiments.
Figure 7:
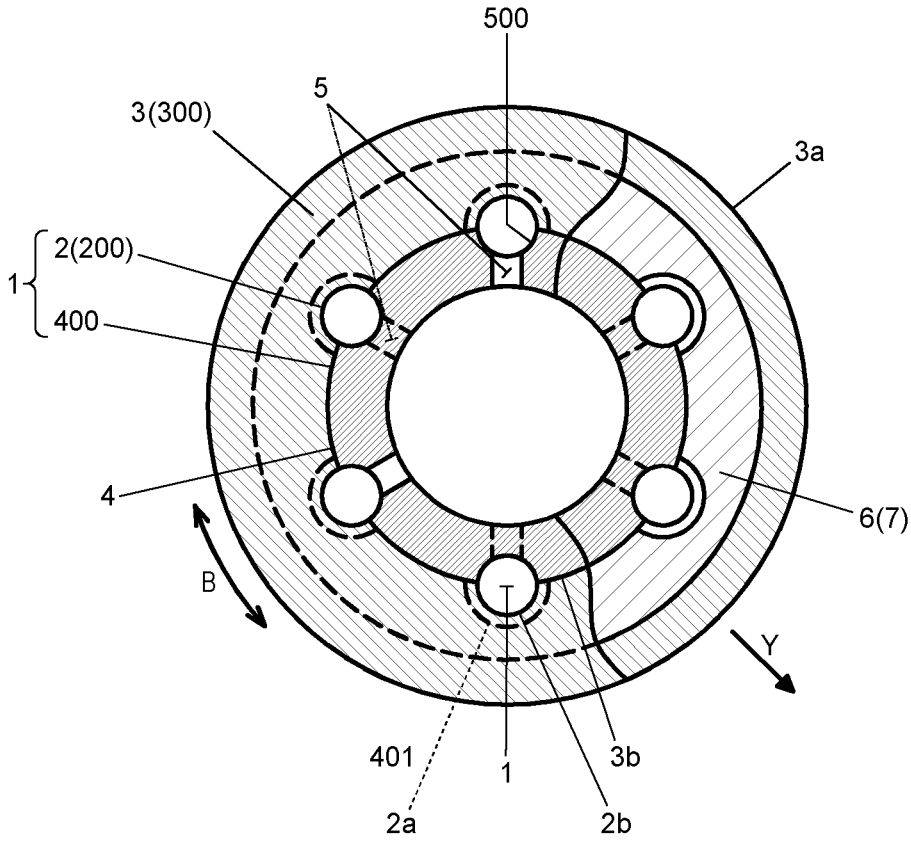
FIG. 7 is a partially-cut cross-sectional view of the functional roll as the third embodiment, showing another type of internal pressure action space (having an upper and lower portion provided on the cut-out portion).
Figure 8:
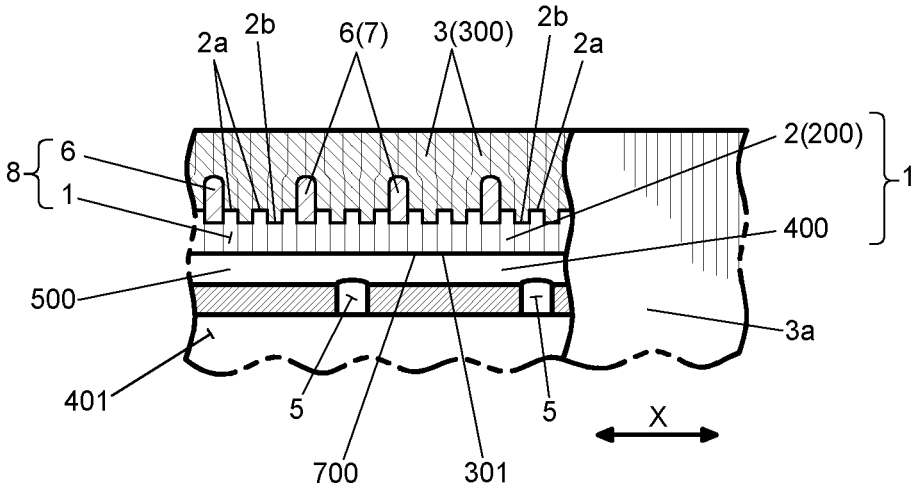
FIG. 8 is an enlarged cross-sectional view, showing the major functional part as shown in FIG. 7.

FIG. 1 is a functional roll as the first embodiment showing a partially-cut cross-sectional view of circumferential direction B. In FIG. 1, internal pressure action space 1 is formed by cross-sectionally tubular shaped cut-out portion 2, made by cutting inner surface 3*b* of high-density porous sheet material 300, incorporating roll hole 301 made of elastic non-woven sheet material with appropriate width A1 (large diameter), or functional composite sheet material, in which cross-linking elastic material is provided thereto, and circumference 400 of tubular roll axis 4 provided through roll hole 301 of sheet material 300. And multiple fine pores 5 (as a structure for fluid permeability) are provided on circumference 400 of roll axis 4. Also, roll axis 4 is formed by axis unit 4*a* in a tubular (cylindrical) shape having hole 401, retainer portions 4*b*, 4*b* provided at both ends of axis unit 4*a*, and bearing 4*c*, 4*c* (i.e. bearing support) incorporating communicating hole 402 at one end. As shown in the third embodiment of FIGS. 5, 7 and 8, tubular inner circumference area 200 of cut-out portion 2 of internal pressure action space 1 is made of upper portion 2*a* and lower portion 2*b* in the direction of X-axis, to enlarge inner circumference area Z1 (circumference area) of tubular inner circumference area 200, as well as to make the cross-sectionally tubular shape with less fluid (gas-liquid) resistance, and accordingly to expand the interface area between roll axis 4 and inner circumference area 200 of cut-out portion 2 of roll unit 3. As described above, expanding the cross-sectionally tubular shape of cut-out portion 2 and/or the area of the interface with roll axis 4, makes it possible for example to improve the fluid (gas-liquid) suction action and to propose a structure of the roll axis that is preferably used as the actual equipment (for practical use) and comprising a sufficient number, diameter or the like of pores (i.e. fine pores 5) to secure the mechanical strength of roll axis 4. Also, the cut-out portion is in the shape of a cross-sectional tube extending toward the X-axis, and is formed toward the outer circumferential direction (radial direction Y) of roll hole 301 of sheet material 300. Furthermore, the cut-out portion 2 is multiply provided in circumferential direction B.

Figure 10:
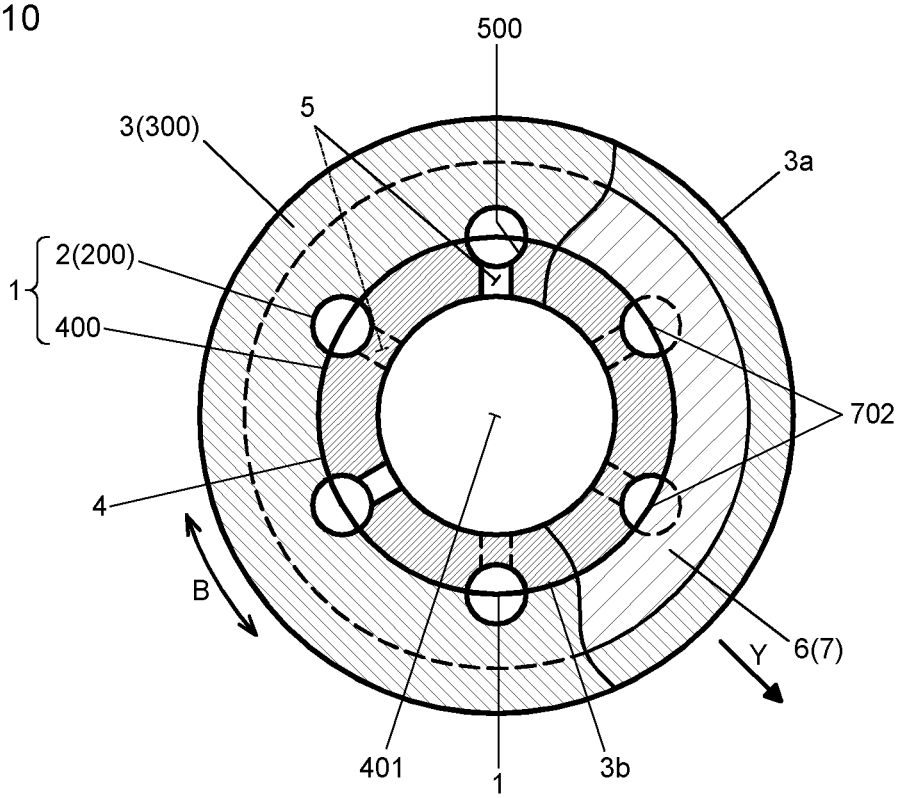
FIG. 10 is a partially-cut cross-sectional view of the functional roll as the fifth embodiment, showing the circumferential direction in which the low-density porous sheet material is projected into the internal pressure action space.
Figure 11:
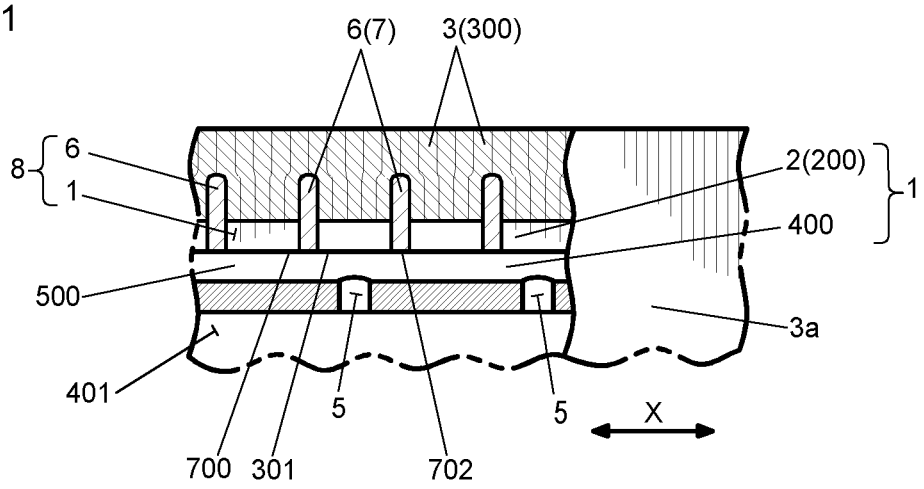
FIG. 11 is an enlarged view, showing the major functional part as shown in FIG. 9.

Internal pressure action space 1 is connected to internal pressure branching guidepath 6, consisting of low-density porous sheet material 7 (sheet material 7), having roll hole 700 made of a piece of elastic non-woven sheet material with an appropriately small width A2 (i.e. small diameter), or functional composite sheet material in which cross-linking elastic material is provided on non-woven material. And sheet material 7 (internal pressure branching guidepath 6) is provided intercrossingly on cut-out portion 2 (internal pressure action space 1), to become part of roll unit 3. Also, sheet material 7 in the first embodiment has cut-out portion 701 of a similar (scaling) relationship with cut-out portion 2 of internal pressure action space 1. However, as shown in FIG. 10 of the fifth embodiment, extended portion 702 is provided to reach cut-out portion 2 of internal pressure action space 1, so that, for instance, extended portion 702 improves the fluid (gas-liquid) suction action and forms the structure of sheet material 7 to become internal pressure branching guidepath 6 that is appropriate for actual use as equipment. Moreover, if extended portion 702 approaches surface 3*a* of roll unit 3, (although it is not shown in the drawings,) it will possibly make a more significant structure in which the fluid (gas-liquid) suction action of internal pressure branching guidepath 6 will directly work on surface 3*a* of roll unit 3. Furthermore, such improvement in suction action can reduce for example the capacity of suction power, thus realizing energy conservation or the like. (Other embodiments also have similar benefits).

Figure 2:
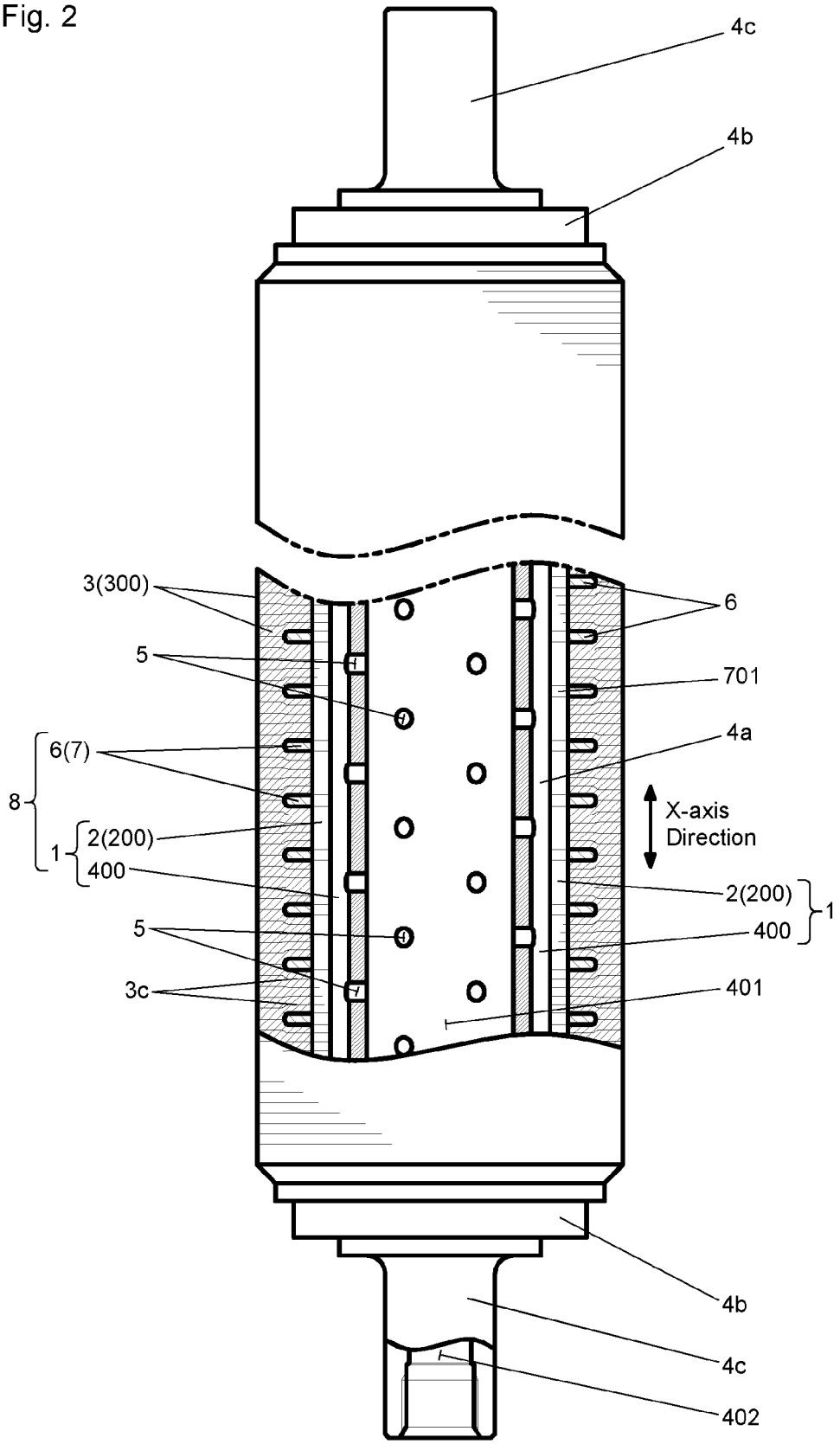
FIG. 2 is a cross-sectional view of a functional roll as the first embodiment.

The first embodiment in FIG. 2 shows a structure forming internal pressure branching guidepath 6 in combination with five pieces of sheet material 300 and one piece of sheet material 7 (as one example). In FIG. 2, it is illustrated by an actual line that the five sheet materials are compressed, so that the shape of both side surfaces 3*c* is changed.

Figure 6:
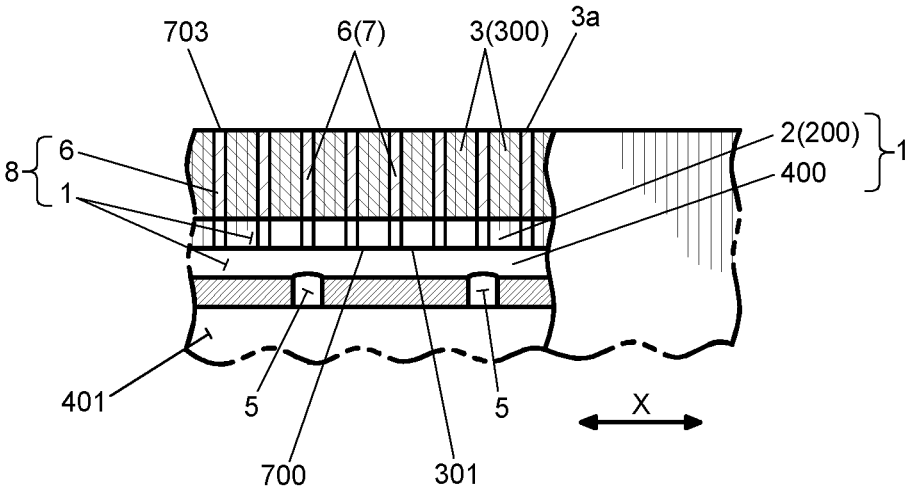
FIG. 6 is a partially-cut and enlarged cross-sectional view of a major structure, showing the internal pressure branching guidepath of the functional roll, as the second embodiment is directly reaching to the surface of the roll unit.

The second embodiment in FIG. 6 shows a structure in which outer circumference 703 of sheet material 7 reaches surface 3*a* of roll unit 3, so that the suction action works on the entire circumference of roll unit 3. This embodiment can also provide another type of more significant structure to activate the fluid (gas-liquid) suction action of internal pressure branching guidepath 6 directly to surface 3*a* of roll unit 3. Other features are pursuant to the aforementioned examples.

Figure 9:
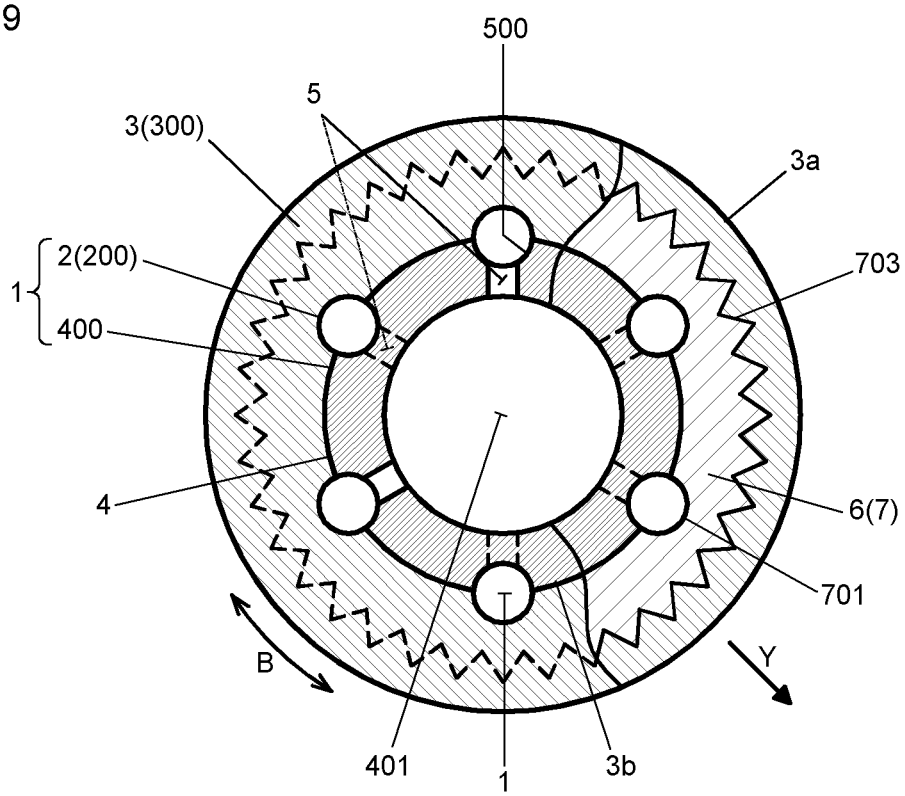
FIG. 9 is a partially-cut cross-sectional view of the functional roll as the fourth embodiment, showing the concavo-convex shape provided on the outer circumferential area of the low-density porous sheet material, to expand the circumferential area.

The fourth embodiment in FIG. 9 shows a structure in which a chevron, wave, or other concavo-convex shape is provided on outer circumference 703 of sheet material 7. Such a structure makes it possible to expand outer circumferential area Z2 of outer circumference 703, thus extending the suction action and improving the suction action of surface 3*a* of roll unit 3. Other features are pursuant to the aforementioned examples.

Figure 3:
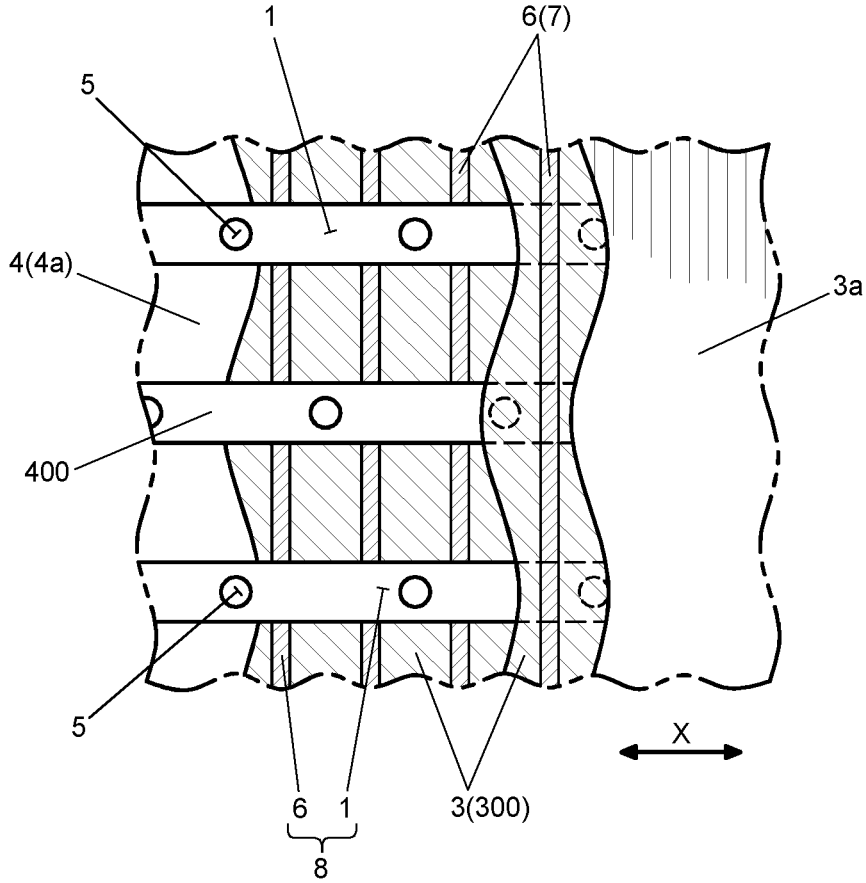
FIG. 3 is an enlarged view of the fine pores of the roll axis and lattice-shaped fluid (gas-liquid) guidepath (internal pressure action space and internal pressure branching guidepath), laterally viewed by partially cutting the side surface lines A and B as shown in FIG. 1.
Figure 4:
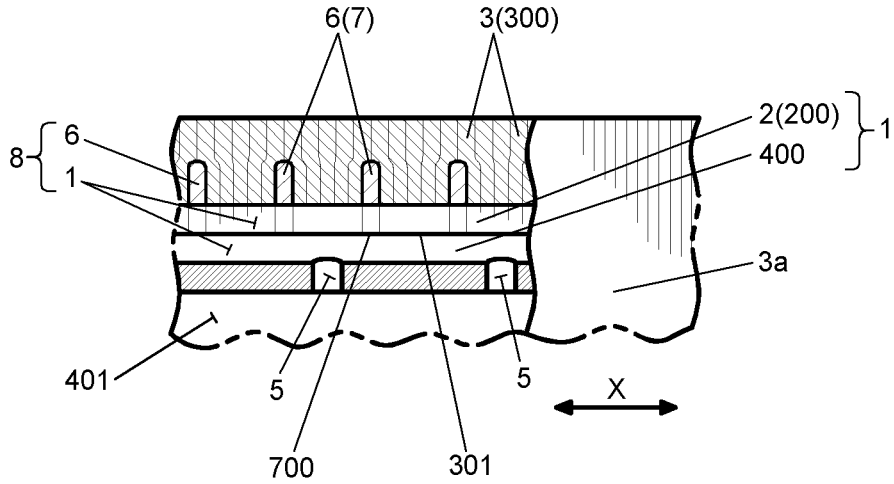
FIG. 4 is an enlarged view of the major portion as shown in FIG. 2

As described above, internal pressure action space 1 and internal pressure branching guidepath 6 are cross-linking and compounded, eventually forming lattice-shaped fluid (gas-liquid) guidepath 8, as shown in FIG. 3. In FIG. 3, lattice-shaped fluid (gas-liquid) guidepath 8 is accurately and properly connected to multiple fine pores 5 of roll axis 4, so that for instance the internal pressure of roll axis 4 is activated toward inner surface 3*b* of roll unit 3 facing inner surface 3*a* of the roll (inner surface 3*b* facing outer circumference 400 of roll axis 4 and has a roll hole 301), and also has the feature of dispersing and distributing the internal pressure, thus enhancing the fluid (gas-liquid) suction action. Furthermore, equal distribution of the internal pressure is provided on surface 3*a* of roll unit 3. In other words, such internal pressure efficiently functions as a preferable action to roll unit 3 (the roll action site). Such an efficient function can reduce for example the capacity of the suction power, thus realizing energy conservation or the like. (Other embodiments also have similar benefits).

As shown in FIG. 3, internal pressure action space 1 and internal pressure branching guidepath 6 are preferably embedded crisscross over circumference 400 of roll axis 4 to form up a lattice shape, so that lattice-shaped fluid guidepath 8 (fluid guidepath incorporating a lattice-shaped structure) is integrally formed. The structure of the internal pressure covering the complicated porous structure of roll unit 3, and the fluid (gas-liquid) suction action and entire roll unit 3 is greatly rationalized and simplified to reduce the number of parts, and naturally contributes to cost reduction and energy conservation. Moreover, in no small measure, it practically and efficiently contributes to maintaining mechanical property and stability. Furthermore, a pipe (not shown in the drawings) to internally activate a suction action, is connected to hole 401 of roll axis 4, through communicating hole 402. Thus, the suction action working on roll axis 4 effectively transmits the fluid (gas-liquid permeability) suction action running from fine pores 5 to lattice-shaped fluid guidepath 8 (from internal pressure action space 1 to internal pressure branching action guidepath 6), and the surface fluid (gas-liquid) suction action of roll unit 3 is activated when the internal pressure of roll axis 4 is used as negative (vacuum) pressure. And the sucked-out fluid runs in negative pressure through lattice-shaped fluid guidepath 8 (internal pressure branching guidepath 6 to internal pressure action space 1) and fine pores 5, and then efficiently runs through hole 401 of roll axis 4 to communicating hole 402.

Also, as multiply shown in the drawings, tubular recess 500 is provided on the external side (outer circumference 400) of fine pores 5, provided on roll axis 4, so that the suction action of fine pores 5 is improved. In this case, mechanical strength of roll axis 4 should be ensured.

Figure 12:
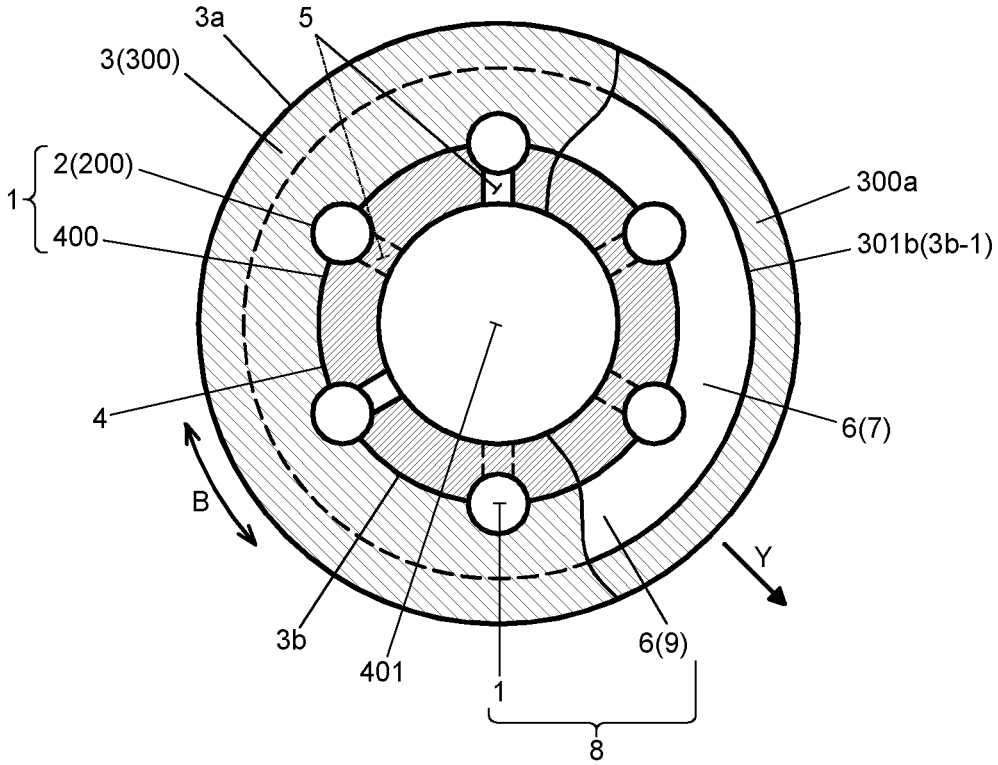
FIG. 12 is a partially-cut cross-sectional view of the functional roll as the sixth embodiment, in which a space structure of the internal pressure branching guidepath is made by combining a high-density porous sheet material, and another high-density porous sheet material, incorporating circular pores.
Figure 13:
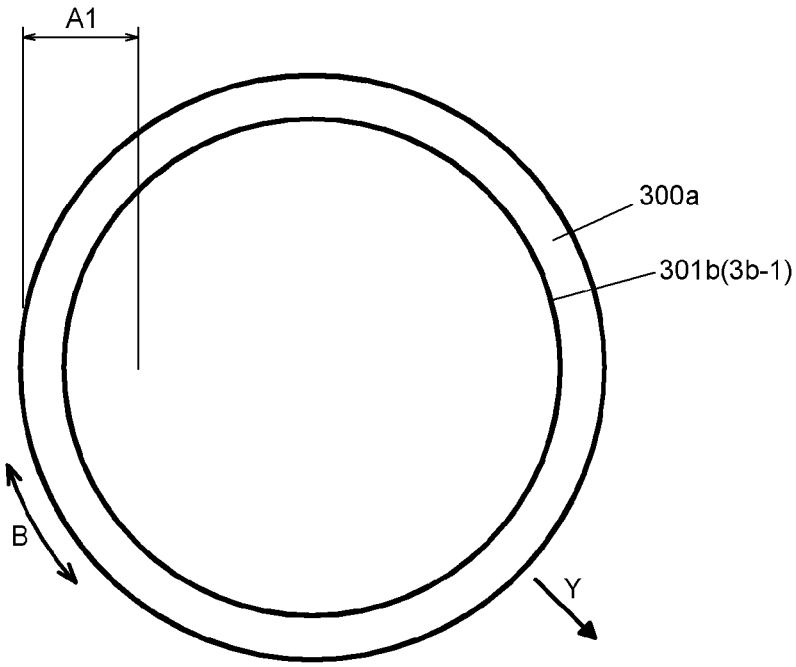
FIG. 13 is a side view of the high-density porous sheet material, incorporating the circular pores, as shown in FIG. 11.

The sixth embodiment in FIG. 12 is sheet material 300*a* (as also shown in FIG. 13) made of an elastic non-woven sheet material or functional composite sheet material in which cross-linking elastic material is provided on non-woven material, and sheet material 300*a* is in the shape of a doughnut having a large diameter inner surface 3*b*-1 of circular hole 301*b* cut out in the outer circumferential direction of roll hole 301 of roll axis 4. The sixth embodiment is one example of forming lattice-shaped fluid guidepath 8, combined with sheet material 300*a* and aforementioned sheet material 300. This example shows that one piece or multi-layered pieces of sheet material 300*a* is provided between one piece or multi-layered pieces of sheet material 300. Thus, each side surface 3*c* of adjacent sheet material 300, together with circular hole 301*b*, makes space 9. Space 9 also becomes internal pressure branching guidepath 6 (extending toward the axis), communicating and simultaneously cross-linking with internal pressure action space 1 and making lattice-shaped fluid guidepath 8. Thus, the structure in which space 9 is alternatively used, instead of aforementioned internal pressure branching guidepath 6, can eliminate the use of sheet material 7, thus leading to reduction in cost.

Figure 14:
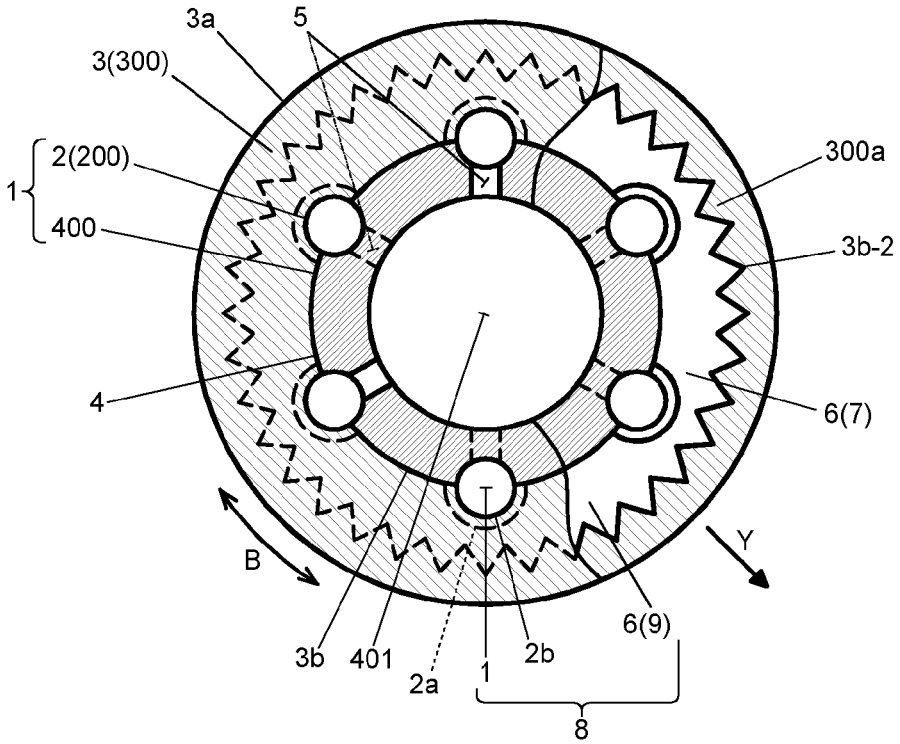
FIG. 14 is a partially-cut cross-sectional view of the functional roll as the seventh embodiment, in which a space structure of the internal pressure branching action guidepath is made by combining a high-density porous sheet material, and another high-density porous sheet material, incorporating circular pores and a concave-convex shaped inner circumference area expanding the circumferential area.
Figures 1, 15:
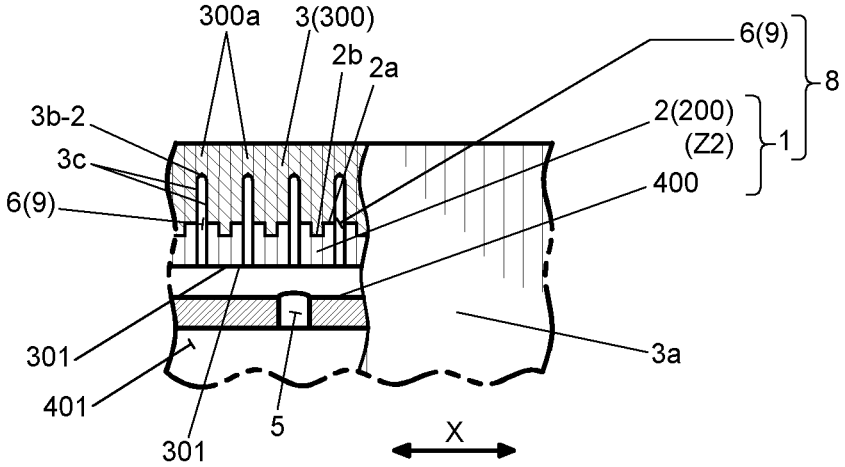
Figures 2, 15:
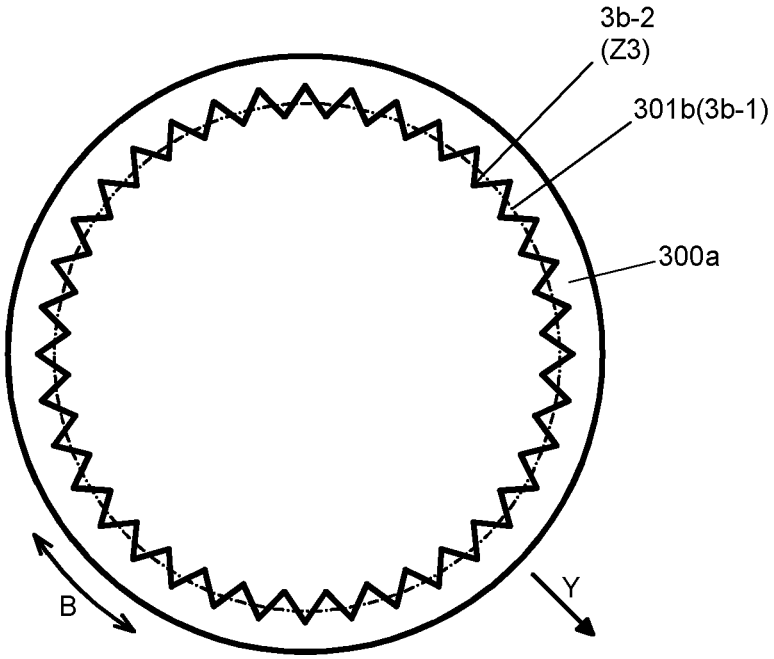
Figure 16:
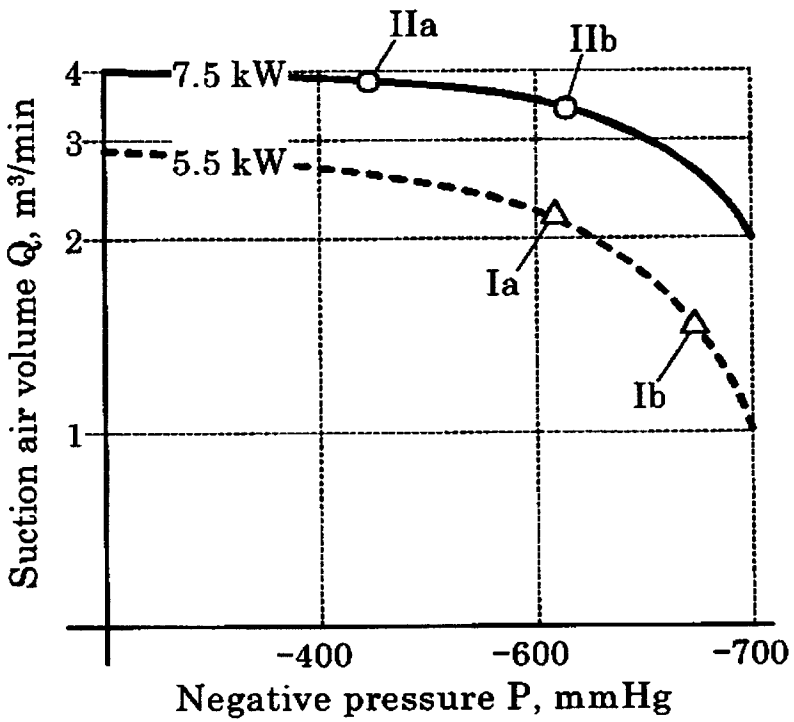
FIG. 16 is a diagram showing the relationship between suction air volume and negative pressure.
Figure 17:
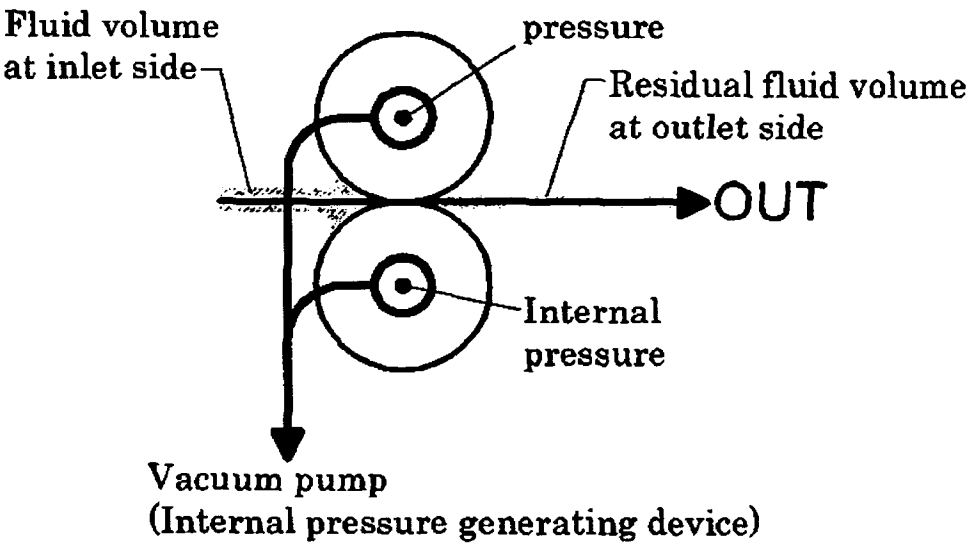
FIG. 17 is a traditional roll unit.
Figure 18:
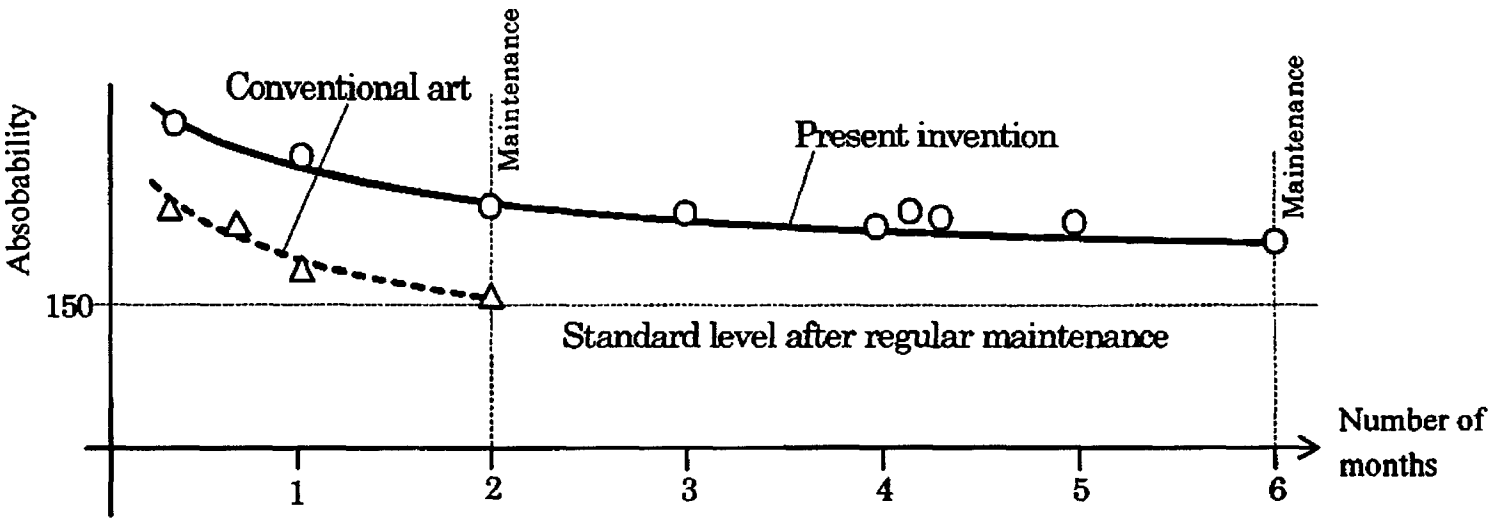
FIG. 18 is the measurement results of variation regarding surface absorbability of the roll unit (roll action site) during actual use.
Figure 19:
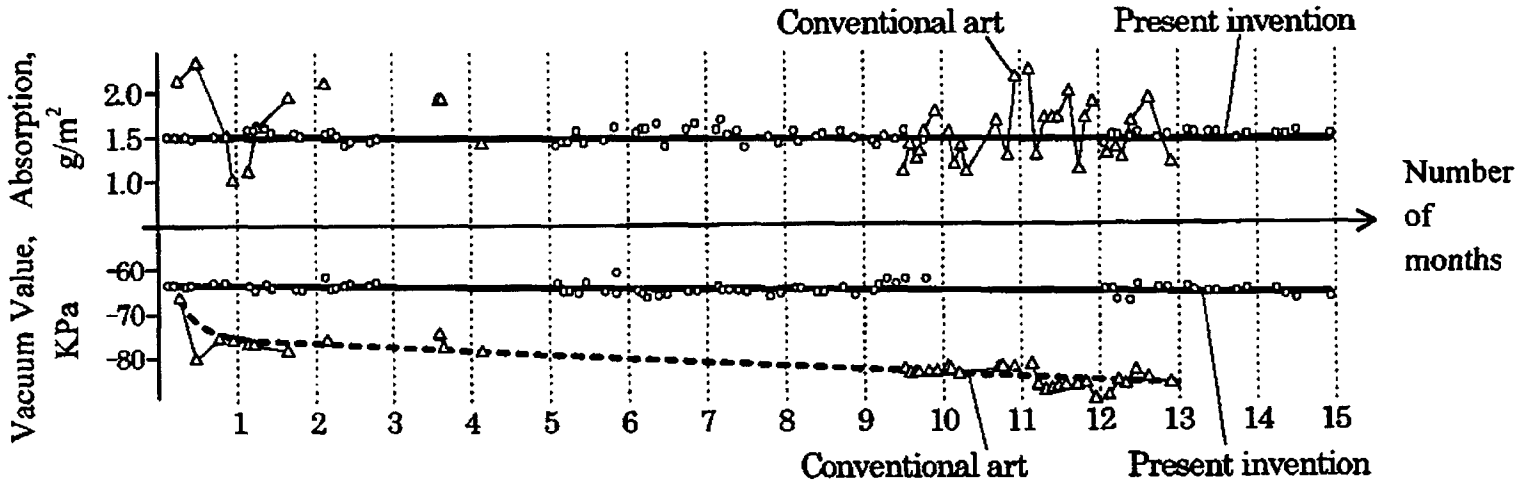
FIG. 19 is the acceleration test results of stability for the present invention and conventional art on the same conditions.

Furthermore, FIG. 14 shows the seventh embodiment derived from the aforementioned sixth embodiment. The seventh embodiment is sheet material 300*a* as shown in FIG. 15-2, in which a chevron, wave or other concavo-convex shape is provided on inner circumference 3*b*-2 of large-diameter inner surface 3*b*-1 to make circular hole 301*b*, to expand inner circumferential area Z3 of inner circumference 3*b*-2, and to expand and improve the suction action of surface 3*a* of roll unit 3. Other features are pursuant to aforementioned embodiment 6. Also, FIG. 15-1 shows a structure in which the seventh embodiment incorporates upper-portion 2*a* and the lower portion 2*b* of the aforementioned third embodiment. Its feature is pursuant to the third embodiment.

To recover the suction action of the functional roll and to renew its production, roll unit 3 is taken out of roll axis 4 and processed by cutting (sanding), or chemically treating it or the like. Thus, it is actually useful in recovering the function of internal pressure action space 1, the function of internal pressure branching guidepath 6, or the function of fine pores 5, as well as recycling them.

| [Explanation of the parts] | |
|---|---|
| 1. | Internal pressure action space |
| 2. | Cut-out portion |
| 200. | Inner circumference area |
| 2a. | Upper portion |
| 2b. | Lower portion |
| 3. | Roll unit |

-continued

| [Explanation of the parts] | |
|---|---|
| 300. | Sheet material |
| 300a. | Sheet material |
| 301. | Roll hole |
| 301b. | Circular hole |
| 3a. | Surface |
| 3b. | Inner surface |
| 3b-1. | Large-diameter inner area |
| 3b-2 | Inner circumference |
| 3c. | Side surface |
| 4. | Roll axis |
| 400. | Circumference |
| 401. | Hole |
| 402. | Communicating hole |
| 4a. | Axis unit |
| 4b. | Retainer |
| 4c. | Bearing |
| 5. | Fine pore |
| 500. | Recess |
| 6. | Internal pressure branching guidepath |
| 7. | Sheet material |
| 700. | Hole |
| 701. | Cut-out portion |
| 702. | Extended portion |
| 703. | Outer circumference |
| 8. | Lattice-shaped gas-fluid (gas-liquid) guidepath |
| 9. | Space |
| A1. | Width (Large diameter) |
| A2. | Width (Small diameter) |
| B. | Circumferential direction |
| X. | Axial direction |
| Y. | Radial direction |
| Z1. | Area |
| Z2. | Area |
| Z3. | Area |

What is claimed is:

1. A functional roll comprising a tubular roll axis with multiple fine pores, and a roll unit having a roll hole engaged with the roll axis comprising a high-density porous sheet material of elastic non-woven sheet material or a functional composite sheet material providing a cross-linking elastic material onto the non-woven sheet material, whereby the roll unit further comprises a lattice-shaped fluid guidepath structure comprising an internal pressure action space comprising a cut-out portion which is provided on the inner circumferential area of the roll unit and provided in the axial direction of the roll unit as well as an internal pressure branching guidepath provided in the radial direction of the roll unit and connected to the internal pressure action space, the internal pressure branching guidepath comprising porous sheet material of the elastic non-woven sheet material or the functional composite sheet material, whereby the porous sheet material has a lower density than the high-density porous sheet material and a roll hole, whereby internal pressure is applied to the aforementioned roll unit through the lattice-shaped fluid guidepath structure, wherein the low-density porous sheet material has an extended portion provided to reach the cut-out portion of the internal pressure branching guidepath which comprises the internal pressure action space.

2. A functional roll as described in claim 1, wherein the cut-out portion is tubularly cross-sectional shaped, and an inner circumference area of the cut-out portion that is provided in the axial direction of the roll unit is concave-convex shaped in the axial direction, to expand the inner circumference area.

* * * * *